United States Patent [19]

Gundzik et al.

[11] 4,036,608

[45] July 19, 1977

[54] METHOD AND APPARATUS FOR CONDENSING PYROLYSIS OILS

[75] Inventors: Richard M. Gundzik, Placentia; Forrest E. Logan, Claremont, both of Calif.

[73] Assignee: Occidental Petroleum Corporation, Los Angeles, Calif.

[21] Appl. No.: 603,877

[22] Filed: Aug. 11, 1975

[51] Int. Cl.[2] ..... B01D 47/00

[52] U.S. Cl. ..... 55/89; 55/228; 261/124

[58] Field of Search ..... 55/84, 85, 89, 228, 55/237, 256, 80; 261/124

[56] References Cited

U.S. PATENT DOCUMENTS

| | | | |
|---|---|---|---|
| 1,594,324 | 7/1926 | Payne | 55/256 |
| 2,721,065 | 10/1955 | Ingram | 55/256 X |
| 2,744,730 | 5/1956 | Merritt | 55/80 X |
| 2,833,528 | 5/1958 | Schroeder | 55/256 |
| 3,016,981 | 1/1962 | Fritz | 55/85 X |
| 3,613,333 | 10/1971 | Gardenier | 55/89 |
| 3,853,505 | 12/1974 | Tretter, Jr. et al. | 55/85 |

*Primary Examiner*—Frank A. Spear, Jr.
*Assistant Examiner*—E. Rollins Cross
*Attorney, Agent, or Firm*—Christie, Parker & Hale

[57] ABSTRACT

A knockout pot for separating pyrolysis oil and heavy hydrocarbon constituents from gaseous constituents in the vapor discharge from a flash pyrolysis process. The knockout pot includes a closed vessel having an inlet pipe extending vertically through the top of the vessel to the interior, the pipe having a plurality of discharge holes in the lower end of the inlet pipe. A quench liquid input is connected tangentially to the inlet pipe on the outside of the vessel, imparting a swirling motion to the quenching liquid. The quench liquid is withdrawn from the vessel and recirculated.

10 Claims, 3 Drawing Figures

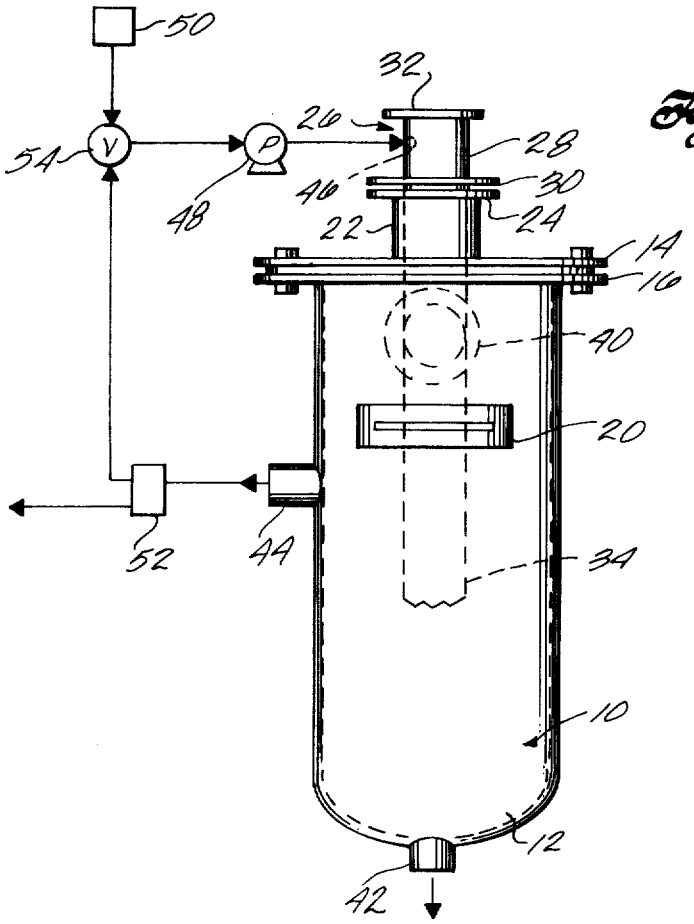
Fig. 1
Fig. 2
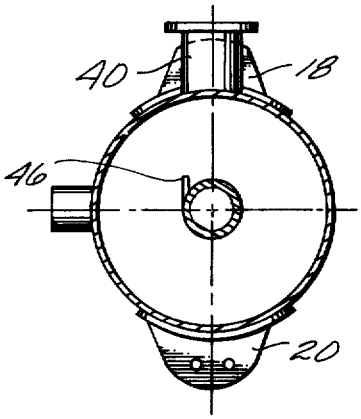
Fig. 3
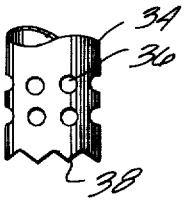

METHOD AND APPARATUS FOR CONDENSING PYROLYSIS OILS

FIELD OF THE INVENTION

This invention relates to pyrolysis of solid organic waste from industrial and municipal sources, and more particularly, is concerned with a method and apparatus for quenching the hot gases containing the pyrolysis products formed in the pyrolysis process.

BACKGROUND OF THE INVENTION

The disposal of wastes both from municipal and industrial sources, such as trash, rubbish, garbage, animal wastes, agricultural wastes, and waste of plastic processing operations, is rapidly becoming of immense national concern. The cost of disposal ranks third behind public schooling and highways as municipal expense in the United States.

It is estimated that each individual in the country generates between 4 and 6 pounds of waste per day, that the industrial output is equivalent to approximately 5 pounds of solid waste per person per day. Previous methods of mass waste disposal, such as landfill, are becoming impossible while others such as incineration are costly and result in air pollution problems.

A vast majority of the waste which is presently disposed of contains products which are immediately recyclable back into the economy or products into which the waste can be converted for recycle back to the economy. Directly recyclable constituents are the various metals present, such as aluminum and steel, and glass. For the most part, the organic fraction of the waste is subject to a flash pyrolysis operation following recovery of the directly recyclable inorganic fraction. Flash pyrolysis yields char, a pyrolytic gas and a pyrolytic oil as products.

A particularly attractive method for converting the solid organic wastes into new and useful products consists of a process where the waste material is first dried and comminuted to a particle size wherein the largest particle has a maximum particle dimension of less than about 1 inch. There is then formed a turbulent gas stream by admixing the dried comminuted waste material with hot char and a carrier gas which does not deleteriously react with or oxidize the organic waste materials or products derived therefrom. The mixture is passed through a flash pyrolysis zone where at a temperature between 600° and 2000° F the organic waste undergoes flash pyrolysis yielding solid char and a vaporized hydrocarbon constituent. The vaporized hydrocarbon constituent is separable as a pyrolytic oil and a normally gaseous hydrocarbon constituent which may be recycled to the process as a carrier gas or conveying gas. Preferably, valuable constituents such as olefin are first removed from the gaseous product. A portion of the char is also recycled as the heat source.

The pyrolytic oils formed, while varying in nature depending upon the composition of the waste material processed and pyrolysis conditions employed, are at the same time unique. They may be characterized as an oxygenated, complex organic fluid, typically up to 40% and in some cases up to 85% soluble in water, acids or base. Solubility in polar organic solvents such as glycerol is limited and the pyrolytic oils are relatively insoluble in non-polar organic solvents, such as diesel oil, carbon tetrachloride, pentane, decane, benzene, toluene and hexane. The pyrolysis oil, however, can be successfully blended and mixed with various No. 6 fuel oils. Combustion stability of the mixture is about the same as No. 6 fuel oil alone.

An example of an elemental analysis of a pyrolytic oil that is obtained from the pyrolysis of a waste material containing about 70% cellulosics is as follows: up to about 60% carbon, from about 5 to about 10%hydrogen, up to about 2% nitrogen and from about 20 to about 40% oxygen. The empirical formula which best fits the pyrolytic oil analysis is $C_5H_8O_2$. Specific gravities are unusually high, ranging from 1.1 to about 1.4.

The hot gases containing the pyrolysis products must be quenched from the high temperature of the flash pyrolysis zone down to temperatures of approximately 300° F or lower, preferably to approximately 200° F or lower. At the same time the velocity of the vapor stream is reduced. The combination of reduced temperature and reduced velocity causes the liquid and solid constituents to condense and drop out of the vapor stream. The quenching liquid is normally introduced into the vapor stream just before or after it enters the knockout pot. However, in the past the quenching of the vapor stream by a cooling liquid has caused severe plugging in the piping adjacent the inlet of the quench liquid.

SUMMARY OF THE INVENTION

The present invention is directed to an improved method and apparatus for quenching the vapor discharge stream from a flash pyrolysis process using a knockout pot. Severe plugging is avoided by using a high boiling point quench liquid and introducing the quench liquid tangentially into the piping entering the knockout pot. Preferably the quench liquid is also resistant to decomposition reaction such as cracking reactions and polymerization reactions. The quench liquid may or may not be partly or wholly soluble with pyrolytic oil. The quench liquid is introduced at a high volume rate, the tangential flow producing a high velocity swirling action within the piping and the knockout pot sufficient for keeping condensable products from precipitating on the walls and forming plugs.

DESCRIPTION OF THE DRAWINGS

For a more complete understanding of the invention, reference should be made to the accompanying drawing, wherein:

FIG. 1 is a side elevational view of a knockout pot;

FIG. 2 is a top view of the knockout pot; and

FIG. 3 is a fragmentary detail view of the inlet pipe in the knockout pot.

DETAILED DESCRIPTION

Referring to the drawings in detail, the numeral 10 indicates generally a hollow cylindrical vessel or tank having a bottom wall 12 and a removable top wall 14. The top wall 14 is bolted or otherwise clamped to the top of the vessel 10 by means of a flange 16. Suitable mounting brackets 18 and 20 are welded or otherwise secured to the outside of the vessel for mounting the vessel in the vertical position shown in the drawings.

The top 14 has an inlet pipe 22 projecting upwardly therefrom and terminating in a flange 24. A nozzle assembly, indicated generally at 26, includes a pipe section 28 which extends downwardly through the inlet pipe 22 into the interior of the vessel 10. A mounting flange 30 is bolted or otherwise secured to the flange 24 to hold the inlet assembly 26 in position. A top flange 32 provides means for coupling the knockout pot to suitable piping (not shown) from a source of high temperature pyrolysis vapors.

The lower end 34 of the pipe 28 terminates within the vessel 10. Preferably a plurality of equally spaced holes 36 spaced around the circumference of the lower end of the pipe 28 are provided for radial escape of the vapors into the interior of the vessel of the knockout pot. The lower end 34 of the pipe terminates preferably in a serrated edge 38.

The knockout pot is provided with a gas outlet pipe 40 extending from the side of the vessel slightly below the top. The pyrolytic oil and heavy hydrocarbon constituents which are condensed out of the pyrolysis vapor are removed through an outlet nipple 42 extending out the bottom 12 and intermediate outlet nipple 44. The intermediate outlet nipple 44 is positioned above the level of the uppermost hole 36 in the lower end of the inlet pipe for removing both the pyrolytic oil and the heavy hydrocarbon constituents of the product liquid as well as the quench liquid from the knockout pot.

To cool or quench the hot pyrolysis vapors entering the knockout pot, a quench liquid is introduced into the vapor stream in the inlet pipe 28. To this end the quench liquid is applied through an input nozzle 46 which enters the inlet pipe 28 tangentially at a point immediately below the coupling flange 32.

In operation, a quench liquid is introduced through the input nozzle 46 by means of a pump 48. The quench liquid is a high temperature heat transfer liquid that is chemically compatible with the pyrolytic oil and heavy hydrocarbons. The quench liquid is preferably an organic solvent having a relatively high boiling point and is resistant to decomposition reactions such as cracking reactions or polymerizing reactions. A suitable quench liquid, for example, is Amsco odorless 450 solvent sold by American Mineral Spirits Company, Division of Union Oil Company of California, which has an initial boiling point of approximately 420° F. The quench liquid is introduced tangentially into the input line 28, which typically is a standard 3-inch line, at a rate of approximately 30 gpm. The quench liquid is initially derived from a suitable storage source 50. As quench operation continues, the quench liquid is recovered from the liquid outflow from the outlets 42 and 44. The quench liquid may be recovered from a suitable separator means 52, such as a decanter tank, and added to the quench liquid from the source 50 by a mixing valve 54.

In operation, the high flow rate of the quench liquid swirls solid materials such as char, semi-solid materials such as very heavy condensible products, and pyrolytic oil and heavy hydrocarbon constituents, out of the knockout pot into the decanter tank. Thus the knockout pot remains free of accumulated liquid and solid products. The tangential flow of the quench liquid limits liquid and solid product buildup and plugging of the inlet pipe due to the quenching of the pyrolysis vapors. While plugging may eventually occur in the inlet pipe above or near the inlet of the quench fluid, such plugs can be easily removed by disconnecting the pipe at the flange 32, or preferably by a deposit removal means which permits removal of the plug during operation without disconnecting the piping or interrupting the flow. Such a pipe removal means for example is a rod which may be raised and lowered inside the pipe and caused to strike any deposits that may form on the wall of the inlet pipe.

It has also been found that by providing heat to the inlet pipe immediately above or near the inlet for the quench liquid that the formation of heavy solid-like pyrolytic product deposits can be substantially prevented. The heat is provided by a heating means which is preferably capable of being controlled so as to provide only that quantity of heat required to prevent the formation of deposits in the inlet pipe near or above the inlet of the quench media. An example of such a controllable heating means is an electric heating tape the heat output of which is controllable by current control devices such as a variable resistance.

What is claimed is:

1. A method for separating pyrolysis oil and a hydrocarbon constituent in a vapor discharge stream from a flash pyrolysis process or a tar producing process comprising the steps of: mixing a high temperature heat transfer fluid with the discharge stream in an inlet pipe having an interior surface extending vertically from above the upper end of a vertically extending closed vessel into the interior of the vessel by directing the high temperature heat transfer fluid tangentially to the flow of the discharge stream in the inlet pipe and along the interior surface of said pipe; bubbling the resulting mixture through a body of liquid contained by the vessel and collected from the mixture discharged from the pipe to the vessel, withdrawing liquid containing primarily pyrolysis oil and high temperature heat transfer fluid from the surface of the contained liquid body, withdrawing heavier oil-solid condensates from the bottom of the contained liquid body, and exhausting the remaining vapor discharge stream from the vessel at a level above the contained liquid body.

2. The method of claim 1 further including the steps of: separating the high temperature heat transfer fluid from the pyrolysis oils, and recirculating the high temperature heat transfer fluid for contact with the vapor discharge stream.

3. A method of separating pyrolysis oil and a hydrocarbon constituent in a vapor discharge stream from a flash pyrolysis process or a tar producing process comprising the steps of: mixing a high temperature heat transfer fluid with the discharge stream, in the inlet pipe having an interior surface extending vertically above an upper end of a vertically extending closed vessel and into the interior of the vessel by directing the high temperature heat transfer fluid tangentially to the flow of the discharge stream in the inlet pipe and along the interior surface of the inlet pipe to condense a portion of the vapor discharge stream; heating the discharge stream at the entry of the high temperature heat transfer fluid sufficiently to prevent formation of a deposit near said entry, bubbling the resulting mixture through a body of liquid contained by the vessel and collected from the mixture; withdrawing liquid containing primarily pyrolysis oil and high temperature heat transfer fluid from the surface of the liquid body; withdrawing heavier oil-solid condensates from the bottom of the liquid body and exhausting the remaining vapor discharge stream from the vessel at a level above the contained liquid body.

4. The method of claim 3 further including the steps of: separating the high temperature heat transfer fluid from the pyrolysis oils, and recirculating the high temperature heat transfer fluid with the discharge stream.

5. A knockout pot for separating pyrolysis oil and heavy hydrocarbon constituents from gaseous constituents in the vapor discharge from a flash pyrolysis process source, comprising: a closed vertically extending vessel having an upper end, and inlet pipe extending vertically from above the upper end into the interior of the vessel; a quench liquid input connected to the inlet pipe outside the vessel, the input forming a passage extending tangentially to the inlet pipe, whereby any liquid entering the inlet pipe is tangential to the flow of vapors through the inlet pipe into the vessel; a first liquid outlet pipe at the bottom of the vessel; a second liquid outlet pipe in the side of the vessel above the outlet of the inlet pipe, and a vapor outlet pipe above the second liquid outlet pipe and adjacent the top of the vessel.

6. The apparatus of claim 5 further including means for recirculating at least a part of the fluid from the second liquid outlet of the vessel to the quench liquid input.

7. The apparatus of claim 5 wherein the inlet pipe has a plurality of discharge holes in the portion of the inlet pipe within the vessel.

8. A knockout pot for separating pyrolysis oil and heavy hydrocarbon constituents from gaseous constitiuents in the vapor discharge from a flash pyrolysis process source, comprising: a closed vertically extending vessel having an upper end, an inlet pipe extending vertically from above the upper end into the interior of the vessel; a quench liquid input connected to the inlet pipe outside the vessel, the input forming a passage extending tangentially to the inlet pipe, whereby any liquid entering the inlet pipe flows tangential to the flow of vapors passing through the inlet pipe into the vessel; a heating means for heating the inlet pipe near the quench liquid input; a first liquid outlet pipe at the bottom of the vessel; a second liquid outlet pipe in the side of the vessel above the outlet of the inlet pipe, and a vapor outlet pipe above the second liquid outlet pipe and adjacent the top of the vessel.

9. The apparatus of claim 8 further including means for recirculating at least a part of the fluid from the second outlet of the vessel to the quench liquid input.

10. The apparatus of claim 8 wherein the inlet pipe has a plurality of discharge holes in the portion of the inlet pipe within the vessel.

* * * * *